US006940217B2

(12) United States Patent
Komiya et al.

(10) Patent No.: US 6,940,217 B2
(45) Date of Patent: Sep. 6, 2005

(54) SHORT ARC ULTRA-HIGH PRESSURE DISCHARGE LAMP

(75) Inventors: Masanobu Komiya, Himeji (JP); Yoshitaka Kanzaki, Himeji (JP); Toyohiko Kumada, Himeji (JP)

(73) Assignee: Ushiodenki Kabushiki Kaisha, Tokyo (JP)

( * ) Notice: Subject to any disclaimer, the term of this patent is extended or adjusted under 35 U.S.C. 154(b) by 175 days.

(21) Appl. No.: 10/307,984

(22) Filed: Dec. 3, 2002

(65) Prior Publication Data

US 2003/0102806 A1 Jun. 5, 2003

(30) Foreign Application Priority Data

Dec. 4, 2001 (JP) ..... 2001-370402

(51) Int. Cl.[7] ..... H01J 61/00

(52) U.S. Cl. ..... 313/491; 313/483; 313/484; 313/567; 313/631; 313/637; 313/638; 313/639

(58) Field of Search ..... 313/483, 484, 313/491, 567, 631, 637, 638, 639, 642

(56) References Cited

U.S. PATENT DOCUMENTS

| | | | | |
|---|---|---|---|---|
| 3,170,081 A | * | 2/1965 | Rokosz | 313/631 |
| 4,703,221 A | * | 10/1987 | Ochoa et al. | 445/27 |
| 5,109,181 A | | 4/1992 | Fischer et al. | |
| 5,277,639 A | | 1/1994 | Nagata et al. | |
| 5,497,049 A | | 3/1996 | Fischer | |
| 5,936,350 A | | 8/1999 | Yoshida et al. | |
| 6,135,840 A | | 10/2000 | Kanzaki | |
| 2001/0005117 A1 | | 6/2001 | Nishida et al. | |
| 2002/0031975 A1 | | 3/2002 | Kanzaki et al. | |

FOREIGN PATENT DOCUMENTS

| | | |
|---|---|---|
| EP | 0 884 763 B1 | 12/1998 |
| JP | 52-131673 | 11/1977 |
| JP | 5-159744 | 6/1993 |
| JP | 10-247473 | 9/1998 |
| JP | 11-7918 | 1/1999 |
| JP | 11-176385 | 7/1999 |
| JP | 11-250806 | 9/1999 |
| JP | 2001-118542 | 4/2001 |
| JP | 2001-126662 | 5/2001 |
| JP | 2001-160374 | 6/2001 |

* cited by examiner

*Primary Examiner*—Nimeshkumar D. Patel
*Assistant Examiner*—Sharlene Leurig
(74) *Attorney, Agent, or Firm*—Nixon Peabody LLP; David S. Safran

(57) ABSTRACT

To devise an arrangement with relatively high pressure tightness, in a short-arc super-high pressure mercury lamp which is operated with an extremely high mercury vapor pressure, a light emitting part has a pair of opposed electrodes and is filled with at least 0.15 mg/mm$^3$ of mercury; and side tube parts extend from opposite sides of the light emitting part, and in which the electrodes are partially hermetically sealed and are each welded to a respective metal foil, in the areas in which the electrodes are welded to the metal foils, the electrodes are deformed in the direction perpendicular to the metal foils to a degree of deformation that is at most 10%.

6 Claims, 6 Drawing Sheets

| Lamp | Degree of deformation of upholding part of the electrode | Number of lamps showing cracks |
|---|---|---|
| 1 | ~0 | 0 |
| 2 | 2 | 0 |
| 3 | 4 | 0 |
| 4 | 5 | 0 |
| 5 | 6 | 0 |
| 6 | 7 | 1 |
| 7 | 8 | 3 |
| 8 | 10 | 3 |
| 9 | 12 | 5 |
| 10 | 15 | 8 |
| 11 | 20 | 10 |

Fig.3

SHORT ARC ULTRA-HIGH PRESSURE DISCHARGE LAMP

BACKGROUND OF THE INVENTION

1. Field of the Invention

The invention relates to a short-arc, ultra-high pressure discharge lamp in which the mercury vapor pressure during operation is at least 150 atm. The invention relates especially to a short-arc, ultra-high pressure discharge lamp which is used as the light source of a liquid crystal display device and a projector device using a DMD (digital mirror device), like a DLP (digital light processor) or the like.

2. Description of Related Art

In a projector device of the projection type noted above, there is a demand for uniform illumination of images onto a rectangular screen with sufficient color reproduction. Thus, the light source is a metal halide lamp which is filled with mercury and a metal halide. Furthermore, recently, smaller and smaller metal halide lamps and more and more often spot light sources have been produced and lamps with extremely small distances between the electrodes have been used in practice.

Against this background, recently, instead of metal halide lamps, lamps with an extremely high mercury vapor pressure, for example, 150 atm, have been proposed. Here, the increased mercury vapor pressure suppresses broadening of the arc (the arc is compressed) and a major increase of the light intensity is desired. One such ultra-high pressure discharge lamp is disclosed in JP-OS HEI 2-148561 (corresponds to U.S. Pat. No. 5,109,181) and JP-OS HEI 6-52830 (corresponds to U.S. Pat. No. 5,497,049).

In such an ultra-high pressure discharge lamp, the pressure within the arc tube during operation is extremely high. Therefore, in the side tube parts which extend from opposite sides of the arc part, it is necessary to arrange the silica glass comprising these side tube parts, the electrodes and the metal foils for power supply sufficiently tightly and directly adjoining one another. When they do not adjoin one another tightly enough, the added gas leaks or cracks form. Therefore, in the process of hermetic sealing of the side tube parts, the silica glass is heated, for example, at a high temperature of 2000° C., and in this state, the silica glass with a great thickness is gradually subjected to shrinking or a pinch seal. In this way, the adhesive property of the side tube parts is increased.

However, if the silica glass is heated up to an excessively high temperature, the disadvantage occurs that, after completion of the discharge lamp, the side tube parts are damaged, even if the adhesion of the silica glass to the electrodes or metal foils is increased.

It can be imagined that the cause of this disadvantage is the following:

After heat treatment, in the stage in which the temperature of the side tube parts is gradually reduced, as a result of differences between the coefficient of expansion of the material (tungsten) comprising the electrodes, and the coefficient of expansion of the material (silica glass) comprising the side tube parts, there is a relative difference in the amount of expansion. This causes the formation of cracks in an area in which the two come into contact with one another.

In order to eliminate this disadvantage, the arrangement shown in FIG. 8 was proposed. Here, the arrangement of the discharge lamp is shown schematically. The light emitting part 2 adjoins the side tube parts 3 in which an electrode 6 (the upholding part 6*a* of the electrode) or an electrode 7 (the upholding part 7*a* of the electrode) are each connected to the metal foil 8. A coil component 10 is wound around the upholding parts 6*a*, 7*a* of the electrodes which have been installed in the side tube parts 3. This arrangement reduces the stress which is exerted on the silica glass as a result of the thermal expansion of the upholding parts 6*a*, 7*a* of the electrode by the coil component 10 which has been wound around the upholding parts 6*a*, 7*a* of the electrode. This arrangement is described, for example, in Japanese patent disclosure document HEI 11-176385.

But in reality, there was the disadvantage that cracks remain in the vicinity of the upholding parts 6*a*, 7*a* of the electrode and the coil component 10 even if the thermal expansion of the upholding parts 6*a*, 7*a* of the electrode is relieved by this arrangement. These cracks are initially extremely small, but there are often cases in which they lead to damage of the side tube parts 3 when the mercury vapor pressure of the light emitting part 10 is roughly 150 atm. Furthermore, in recent years, there has been a demand for a higher mercury vapor pressure of 200 atm and beyond to 300 atm. At such a high mercury vapor pressure, the growth of cracks is accelerated during lamp operation. As a result, there is the disadvantage that damage of the side tube parts 3 clearly occurs. This means than the cracks gradually become larger during operation of a lamp with a high mercury vapor pressure, even if the cracks were extremely small at the start. It can be stated that preventing this problem is a new technical task since the problem never occurred with a conventional mercury lamp with a vapor pressure during operation of at most roughly 50 atm.

SUMMARY OF THE INVENTION

The object of the invention is to devise an arrangement with relatively high pressure tightness in a super-high pressure mercury lamp which is operated with an extremely high mercury vapor pressure.

The object is achieved in accordance with the invention in a short-arc, ultra-high pressure discharge lamp which comprises the following:

- a light emitting part in which there are a pair of opposed electrodes and which is filled with mercury in an amount of at least 0.15 mg/mm$^3$ of the inside volume of the light emitting part;
- side tube parts which extend from opposite sides of the light emitting part and in which the electrodes are partially hermetically sealed and in which the electrodes are each welded to a metal foil; and
- the electrodes, in the areas in which they are welded to the metal foil, are deformed in a direction perpendicular to the metal foils, the degree of deformation being at most 10%.

The object is furthermore achieved according to another aspect of the invention in a short-arc, ultra-high pressure discharge lamp which comprises:

- a light emitting part in which there are a pair of opposed electrodes and which is filled with mercury in an amount of at least 0.15 mg/mm$^3$ of the inside volume of the light emitting part;
- side tube parts which extend from opposite sides of the light emitting part and in which the electrodes are partially hermetically sealed and in which the electrodes are each welded to a metal foil; and
- in the areas in which the electrodes are welded to the metal foil, the diameter of the electrodes is 0.2 mm to 1.0 mm, the width of the metal foils is 1.0 mm to 2.0 mm and the welding area is at most 0.3 $mm^2$.

The object is furthermore achieved according to another aspect of the invention in a short-arc, ultra-high pressure discharge lamp which comprises:

a light emitting part in which there are a pair of opposed electrodes and which is filled with mercury in an amount of at least 0.15 $mg/mm^3$ of the inside volume of the light emitting part;

side tube parts which extend from opposite sides of the light emitting part and in which the electrodes are partially hermetically sealed and in which the electrodes are each welded to a metal foil; and in the areas in which the electrodes are welded to the metal foil, the diameter of the electrodes is 0.2 mm to 1.0 mm, the width of the metal foils is 1.0 mm to 2.0 mm and that the welding sites have a distance that is at least 0.3 mm from the ends of the metal foils.

The invention is further described below using the drawings.

BRIEF DESCRIPTION OF THE DRAWINGS

FIG. 3 is a table showing experimental results for the lamps in accordance with the invention;

DETAILED DESCRIPTION OF THE INVENTION

Figure 1:
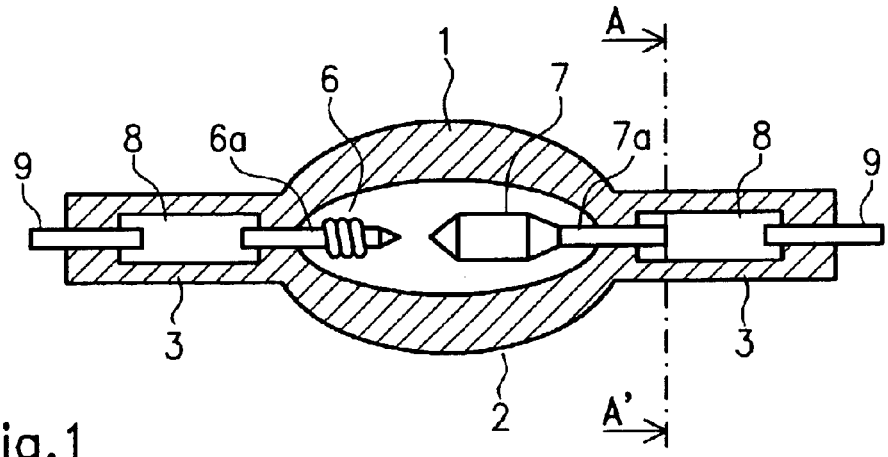
FIG. 1 is a schematic cross-sectional view of the overall arrangement of a short-arc ultra-high pressure discharge lamp in accordance with the invention.

FIG. 1 shows the overall arrangement of an ultra-high pressure discharge lamp (hereinafter also called only a "discharge lamp") in accordance with the invention. In the figure, the discharge lamp 1 has a light emitting part 2 which is formed from a silica glass discharge vessel and which has essentially the shape of rugby ball or football. Within the light emitting part 2, there are a cathode 6 and an anode 7 in opposed relationship to each other. A side tube part extends from each of opposite ends of the light emitting part 2, and in which a conductive metal foil 8, which is normally made of molybdenum, is hermetically enclosed, for example, by a pinch seal. The ends of the upholding parts 6*a*, 7*a* of the electrode which have either the cathode 6 or the anode 7 on their tip are each located on one of the ends of the metal foils 8, are welded on in this state and are electrically connected thereto. An outer lead 9 which projects to the outside is welded to the other end of the respective metal foil 8. There are cases in which the cathode 6 and anode 7 each have at the tip a part with an increased diameter, and also cases in which they do not have a part with an increased diameter at the respective tip. Furthermore, it is also possible for the term "electrode" to include the upholding parts 6*a*, 7*a* of the electrode. The light emitting part 2 is filled with mercury, a rare gas and if necessary also a halogen gas.

The mercury is used to obtain the necessary, visible radiation, for example, to obtain radiant light with wavelengths of 360 to 780 nm, and is added in an amount of greater than or equal to 0.15 $mg/mm^3$, for example, of 0.17 $mg/mm^3$, 0.20 $mg/mm^3$, 0.25 $mg/mm^3$, or 0.30 $mg/mm^3$, relative to the inside volume of the emission space. This added amount is given here for filling at room temperature. However, the actual vapor pressure changes with temperature. During operation, a pressure of at least 150 atm, therefore, an extremely high vapor pressure, is reached. By adding a larger amount of mercury, a discharge lamp with a high mercury vapor pressure during operation of greater than or equal to 200 atm or at least 300 atm can be produced. The higher the mercury vapor pressure, the more suitable a light source for a projector device which can be implemented.

For example, roughly 13 kPa argon gas is added as the rare gas, by which the operation starting property is improved.

Iodine, bromine, chlorine, and the like in the form of a compound with mercury and other metals are added as the halogen. The amount of halogen added can be selected, for example, from the range of $10^{-6}$ to $10^{-2}$ $\mu mol/mm^3$. The function of the halogen is to prolong the service life using the halogen cycle. For an extremely small discharge lamp with a high inner pressure, like the discharge lamps of the invention, by adding halogen blackening and devitrification of the discharge lamp can be prevented.

The numerical values of one such discharge lamp are given below by way of example, as follows:

maximum outside diameter of the light emitting part 9.5 mm;

the distance between the electrodes 1.5 mm;

inside volume of the arc tube 75 $mm^3$;

nominal voltage 80 V;

nominal wattage 150 W.

This short-arc, ultra-high pressure discharge lamp is located in a small projector device or the like. The overall arrangement is very small. On the other hand, there is a need for a large amount of light. The thermal conditions within the light emitting part are therefore extremely strict, i.e., the value of the wall load is 0.8 $W/mm^2$ to 2.0 $W/mm^2$, specifically 1.5 $W/mm^2$. The lamp is installed in the above described projector device or in a presentation apparatus such as an overhead projector and can offer radiant light with good color reproduction.

Figure 2A:
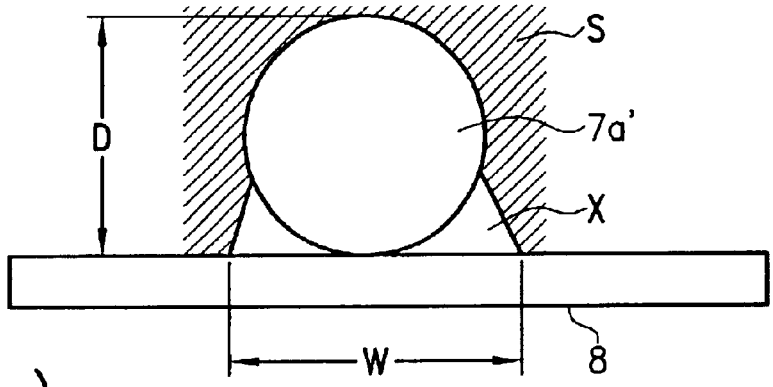
FIGS. 2(*a*) & 2(*b*) each show an enlargement of the area in which the upholding part of the electrode is connected to the metal foil.
Figure 2B:
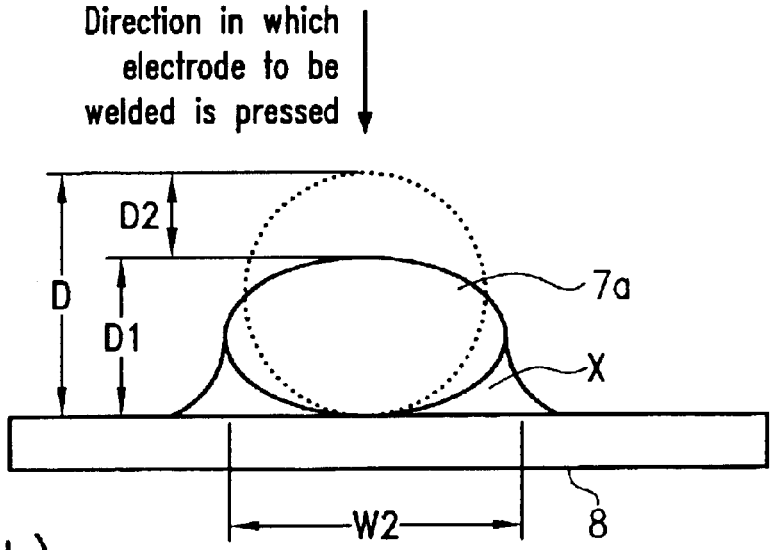

FIGS. 2(*a*) & 2(*b*) each show a cross section along line A–A' as shown in FIG. 1. Both FIG. 2(*a*) and also FIG. 2(*b*) show the state after welding of the upholding part of the electrode to the metal foil. FIG. 2(*b*) schematically shows the case in which a welding rod is used to apply pressure. FIG. 2(*a*) schematically shows the case in which a welding rod is not used to apply pressure. FIG. 2(*a*) shows the silica glass S. In FIG. 2(*b*), the silica glass S is not shown for purposes of simplification.

The electrode rod 7*a* and the metal foil S are connected to one another by resistance welding. If, after welding, the process of hermetic sealing in the silica glass is completed, a gap X inevitably forms between the upholding part 7*a* of the electrode, the metal foil 8 and the silica glass S.

If, in doing so, a welding rod is used to apply high pressure, as is shown in FIG. 2(*b*), the electrode rod 7*a* deforms such that it widens in the transverse direction of the metal foil 8. According to this deformation, the upholding part 7*a* of the electrode deforms from the height D (height in the direction up and down in the plane of the drawing) to the height D1 and shrinks by D2 (i.e., D–D1). The width W of the gap X also increases from W1 as shown in FIG. 2(*a*) to W2 as shown in FIG. 2(*b*).

In the invention according to a first aspect, it was noted that this deformation of the upholding part of the electrode which is formed by pressure by means of the welding rod, and the resulting enlargement of the width of the gap X have a great effect on the formation of cracks in a discharge lamp with an extremely high pressure, as with an internal pressure during operation of greater than or equal to 150 atm.

It can be imagined that the reason for this is the following:

Since the internal pressure during operation is high, a high pressure is exerted via the extremely small space in the vicinity of the respective upholding part of the electrode from the light emitting part on the gap X; this promotes formation and growth of cracks. This is a disadvantage which would never occur in a conventional discharge lamp (with an internal pressure during operation of at most roughly 50 atm during operation). In other words, in a conventional discharge lamp, there was no technical idea of carrying out resistance welding with consideration of the inevitably forming gap X.

In the invention, according to its first aspect, it was found that at a degree of deformation of the upholding part of the electrode of at most 10%, preferably at most 7%, especially preferably at most 5%, cracks neither form nor grow. Here, the term "degree of deformation of the upholding part of the electrode" is defined as a degree of deformation (D2/D) in the direction in which the welding rod is pressed (in the direction perpendicular to the metal foil.

The experimental result for confirming the possible effects of the invention is described below. In the test the intensity of the pressure by the welding rod was changed and the degree of deformation and formation of cracks were observed.

Discharge lamps with an essentially identical shape and essentially identical dimensions were used. The inside volume of the arc tube was roughly 0.1 $cm^3$, the distance between the electrodes was roughly 1.0 mm, the nominal luminous current was roughly 3.5 A and the nominal luminous wattage was roughly 200 W. The lamps were operated using a direct current. Mercury was added in an amount of 0.20 $mg/mm^3$.

The degree of deformation was measured in such a way that the outside diameter of the respective upholding part of the electrode before welding to the respective metal foil was taken as the prototype dimension and that, with consideration of the ratio to the height of the respective upholding part of the electrode after welding, "100–(dimension after welding/dimension of the prototype)×100" was regarded as the degree of deformation. The degree of deformation, for example, in the case in which the prototype dimension of the upholding part of the electrode is a diameter of 0.425 mm and the dimension after welding is a diameter of 0.375 mm, is roughly 12 by "100–(0.375/0.425)×100".

After measuring the degree of deformation, the outer leads are welded to the metal foils and after the processes of hermetic sealing in the silica glass, adding the gas, evacuation and the like the discharge lamp is finished.

The formation of cracks was visually observed in the side tube parts after operation of these discharge lamps of 462 hours (after operation of 2 hours 45 minutes, the lamps were turned off for 15 minutes. This process is repeated for 500 hours). In each case, 100 discharge lamps were operated with the same degree of deformation and after 500 hours the situation of crack formation was confirmed.

FIG. 3 shows the experimental result. Here, it is confirmed that the probability of formation of cracks is extremely low at a degree of deformation of at most 10%. Furthermore, it was confirmed that at a degree of deformation of at most 7% the probability of formation of cracks is even less, and that at a degree of deformation of at most 5%, the formation of cracks is completely suppressed.

In the cases in which it was assessed that cracks had formed, those lamps were considered which do not have any damage during operation of 462 hours in this test, but in which there was the possibility that they are damaged by subsequently continued operation.

In Japanese patent application HEI 2000-168798, the applicant proposed a discharge lamp and a process for its production in which, to prevent the formation of cracks in the silica glass which is present in the vicinity of the upholding part of the electrode, there is intentionally an extremely small space between the two. In a discharge lamp with this arrangement, a high inner pressure of the light emitting part acts directly on the gaps which inevitably form between the metal foils and the upholding parts of the electrode. Therefore, it is extremely effective to use the arrangement in accordance with the invention.

The invention is described below according to another aspect of the invention.

Figure 4A:
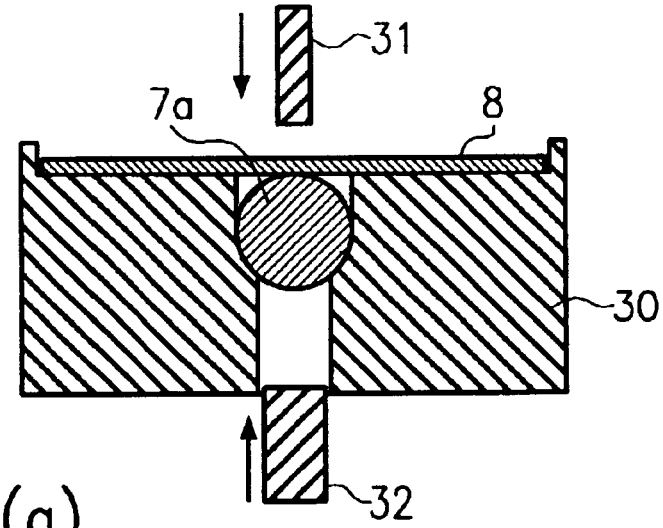
FIGS. 4(*a*) to 4(*c*) each show an enlargement of the area in which the upholding part of the electrode is connected to the metal foil.
Figure 4B:
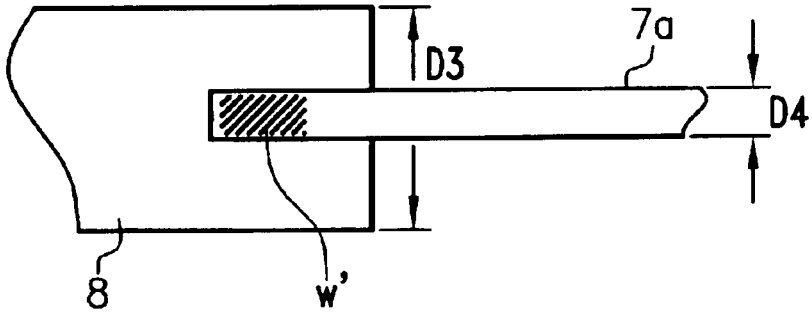
Figure 4C:
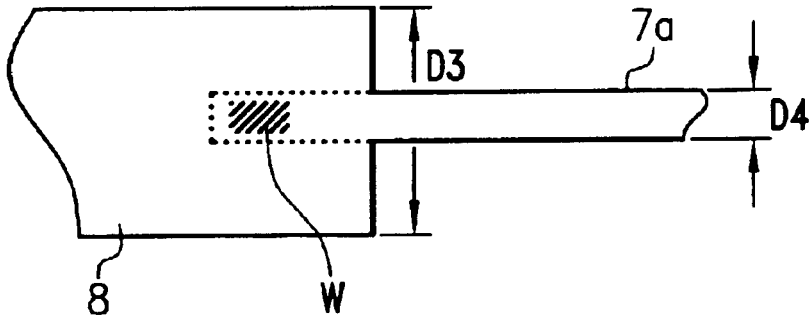
Figure 5A:
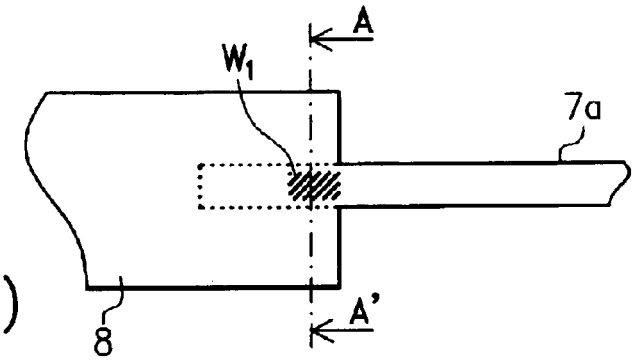
FIGS. 5(*a*) to 5(*d*) each show an enlargement of the area in which the upholding part of the electrode is connected to the metal foil.
Figure 5B:
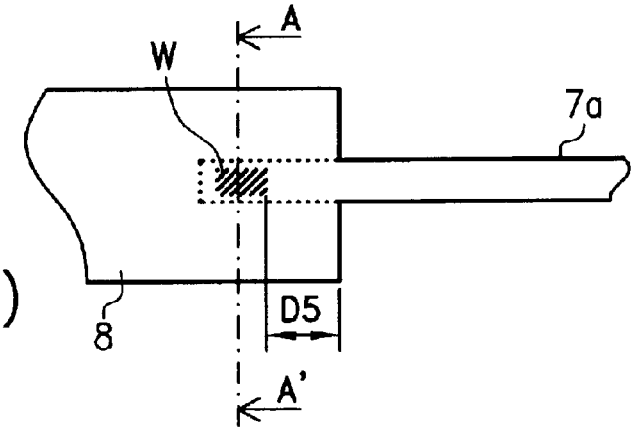
Figure 5C:
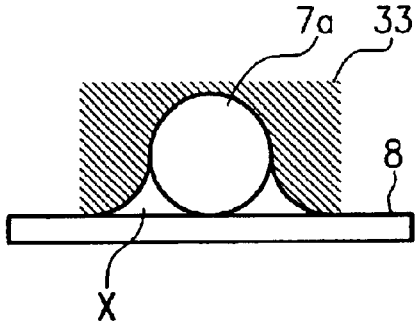
Figure 5D:
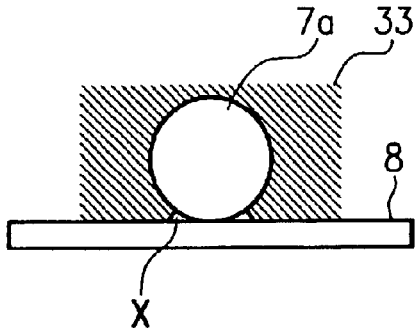

FIGS. 4(*a*) to 4(*c*), as in FIGS. 2(*a*) & 2(*b*), show the area in which the upholding part 7*a* of the electrode is connected to the metal foil 8. FIG. 4(*a*) shows the state in which the upholding part of the electrode 7*a* is welded to the metal foil 8. FIG. 4(*b*) is an enlargement after welding, which has been viewed from the side on which the upholding part 7*a* of the electrode is present (viewed from the lower welding rod 32 which is shown in FIG. 4(*a*)). FIG. 4(*c*) is likewise an enlargement after welding which has been viewed from the side on which the upholding part 7*a* of the electrode is absent (viewed from the upper welding rod 31 which is shown in FIG. 4(*a*)).

In FIG. 4(*a*) the upholding part 7*a* of the electrode and the metal foil 8 are located in a template 30 in which a given shape is formed, and by pressing the upper welding rod 31 and the lower welding rod 32 against one another resistance welding is done. The reason that the lower welding rod 32 is thicker is to prevent the upholding part 7*a* of the electrode from locally deforming.

FIG. 4*b* shows the area W' with which the lower welding rod 32 is in contact for the upholding part 7*a* of the electrode which has been welded to the metal foil 8. FIG. 4(*c*) shows the area W in which the upholding part 7 of the electrode is welded to the metal foil 8 by the upper lower welding rod 31 when the upholding part 7*a* of the electrode is welded to the metal foil 8.

In the short-arc, ultra-high pressure discharge lamp according to the invention which is used as the light source of a projector device, the size of the metal foil and of the upholding part of the electrode is to a certain extent limited. The width D3 of the metal foil 8 is generally selected to be in the range from 1.0 mm to 2.0 mm. The outside diameter D4 of the upholding part 7*a* of the electrode is generally selected to be in the range from 0.2 mm to 1.0 mm.

With respect to this size of the metal foil and the upholding part of the electrode, the invention has the feature that the size of the welding area W of the two is fixed at less than or equal to 0.3 $mm^2$.

The reason for fixing the area of the welding area is the following:

In the case of a large welding area W, the metal foil is partially removed from the silica glass in the vicinity of this welding region, by which an extremely small space is formed between the two. This is the so-called "foil floating phenomenon". It can be imagined that the high pressure within the light emitting part acts on the extremely small space which has been formed by this foil floating phenomenon and that in this way crack formation and arc tube damage are caused.

The reason why the size of the welding area causes formation of foil floating is not entirely clear. But the following can be imagined.

In the area in which the upholding part of the electrode is welded to the metal foil, a state is produced in which the tungsten comprising the upholding part of the electrode is alloyed with the molybdenum comprising the metal foil. Since this alloyed area has a coefficient of thermal expansion which is different from that of the pure molybdenum part, in a wide metal foil a difference forms between the degree of contraction of the alloy part and the degree of contraction of the molybdenum part; this presumably leads to foil floating. Furthermore, there are also cases in which impurities, such as dust and the like, adhere to the welding surface of the welding rod. These impurities have adverse effects, such as producing impurity gas in the process of hermetic sealing and faulty hermetic sealing. That is, a large welding area means that this formation of impurity gas and faulty hermetic sealing occur more frequently.

In this respect, in a conventional discharge lamp, only with consideration of the aspect of electrical connection the two are connected to one another. In the invention, it is detected that for a discharge lamp with an extremely high inner pressure during operation of at least 150 atm, the welding area causes crack formation and lamp damage. Therefore, in accordance with the invention, the welding area is fixed to achieve this entirely new technical object.

The invention is described below according to another aspect.

FIGS. 5(*a*) to 5(*d*), like FIGS. 4(*a*) to 4(*c*), each show schematically the area in which the upholding part 7*a* of the electrode is connected to the metal foil 8. FIGS. 5(*a*) & 5(*b*) are each an enlargement after welding of the upholding part of the electrode to the metal foil and each show a state (corresponds to FIG. 4(*c*)) which was viewed from the side on which the upholding part 7*a* of the electrode is not present. FIGS. 5(*c*) & 5(*d*) are each a cross section corresponding to the line A–A' as shown in FIGS. 5(*a*) & 5(*b*) including the silica glass.

In FIG. 5(*b*), the upholding part 7*a* of the electrode and the metal foil 8 are welded to one another in the welding region W. The welding region W is formed at a position which is away from the electrode-side end of the metal foil 8 by a distance D5. In FIG. 5(*a*), the welding region W1 is formed on one end of the metal foil 8 or essentially in the vicinity thereof. This welding takes place by resistance welding with the arrangement shown above using FIG. 4(*a*).

FIG. 5(*c*) is a cross section corresponding to line A–A' when the welding region W1 is present. FIG. 5(*d*) is a cross section corresponding to line A–A' when the welding region W is present. The cross-hatched area 33 shows silica glass in the vicinity. A gap X is formed by the upholding part 7*a* of the electrode, the metal foil 8 and the silica glass 33.

Comparison of 5(*c*) with 5(*d*) shows that the size of the gap X for 5(*c*) differs greatly from the size of the gap X for 5(*d*) and that the size (cross-sectional area of the opening) of the gap X can be reduced by moving the welding region away from the end of the metal foil.

Since ultra-high pressure within the light emitting part is at the gap S via the extremely small gap which is formed in the above described manner in the vicinity of the upholding part 7*a* of the electrode, a reduction in the size of this gap X means that crack formation in the side tube parts and damage to the discharge lamp can be advantageously prevented, as was described above.

As was described above, in a short-arc, ultra-high pressure discharge lamp which is used as the light source of a projector device the size of the metal foil and of the upholding part of the electrode is limited to a certain extent. Generally the width D3 of the metal foil 8 is 1.0 mm to 2.0 mm and the outside diameter D4 of the upholding part 7*a* of the electrode is 0.2 mm to 1.0 mm. It has been found that there is no adverse effect on the gap X, such as crack generation or the like, when, for this shape and this size, the welding region is at the position which is greater than or equal to 0.3 mm away from the end of the metal foil (from the end on the side of the light emitting part; distance D5 as shown in FIG. 5(*b*)).

At a distance of at least 0.4 mm a greater action is developed. Furthermore, it has been found that an outstanding effect is developed when the distance is preferably at least 0.5 mm. If the distance is too great, with respect to the electrical connection there is, however, a fault. It is necessary for the distance to be at most 1.0 mm.

The reason why the position of the welding region W is associated with the gap X in this way is not entirely clear. However, the following can be imagined.

Figure 6A:
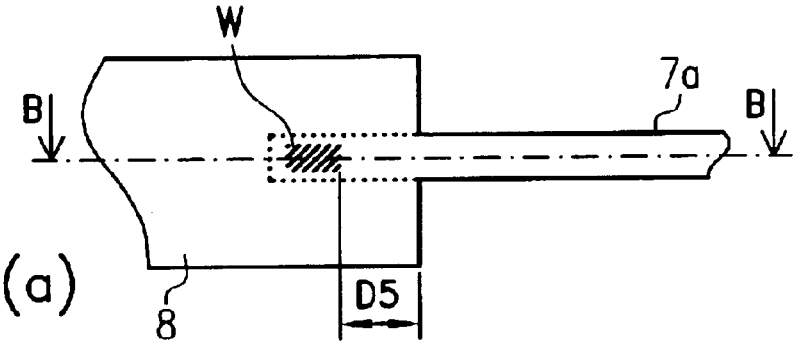
FIGS. 6(*a*) to 6(*b*) each show an enlargement of the area in which the upholding part of the electrode is connected to the metal foil.
Figure 6B:
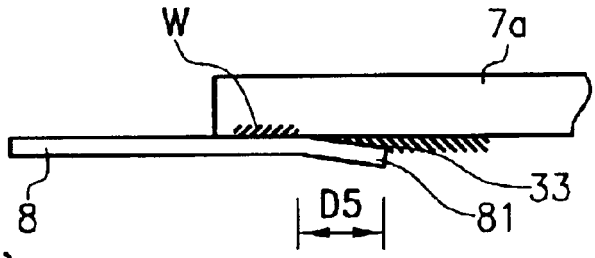
Figure 8:
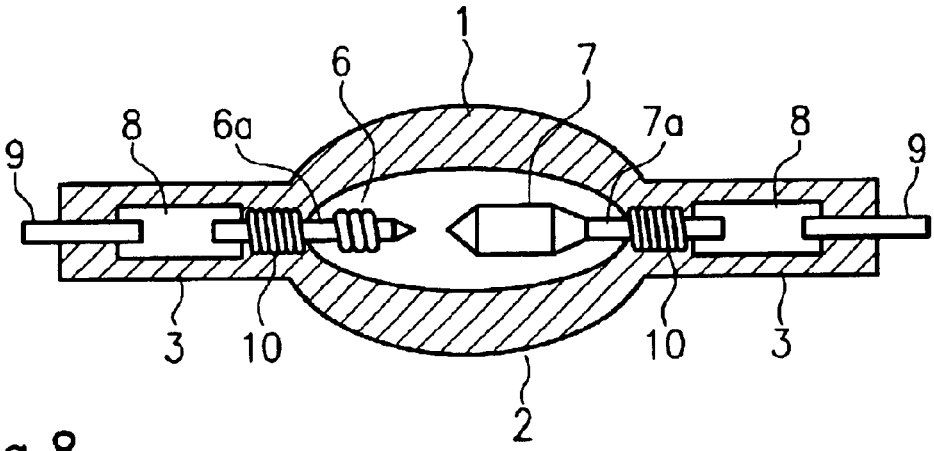
Fig.8 (Prior Art)
FIG. 8 is a schematic cross-sectional view of the overall arrangement of a conventional short-arc, ultra-high pressure discharge lamp.

FIGS. 6(*a*) & 6(*b*) each show a schematic of the relationship of the welding region W to the gap X. FIG. 6(*a*) is a representation which has been viewed from the side on which the upholding part of the electrode of the welding region is absent (corresponds to FIG. 5(*a*)). FIG. 6(*b*) is a cross section corresponding to the line B—B as shown in FIG. 6(*a*).

As is shown in FIG. 6(*b*), one end 81 of the metal foil 8 becomes the free end when the welding region W (welding site) is away from the end of the metal foil 8 (in FIG. 6(*b*) the distance D5 away). In the process of hermetic sealing in the silica glass after joining the upholding part of the electrode to the metal foil, it is therefore allowed that the silica glass 33 penetrates between the upholding part of the electrode and the metal foil.

The presence of the silica glass 33 advantageously prevents formation of the gap X. The gap X can form in the vicinity of the welding region W. On the end on the side of the light emitting part however a gap does not form or it is made smaller here. A continuous connection to the light emitting part is therefore also prevented. As a result the gap which forms in the welding region W has no effect on cracks and damage.

The test result is described below; it shows that the invention according to the above described aspects, i.e., the fixing of the welding area, on the one hand, and the fixing of the welding site, on the other hand, are related to the formation of cracks and lamp damage.

Roughly 30 discharge lamps with an essentially identical shape and essentially identical dimensions were produced and studied. In the stage in production of the respective lamp in which the upholding parts of the electrodes were welded to the metal foils, the welding area and the distance between the end of the respective metal foil and the welding site was measured. In these discharge lamps for example the inner volume of the arc tube was roughly 0.1 $cm^3$ and the distance between the electrodes was roughly 1.0 mm. Mercury was added in an amount of roughly 0.20 $mg/mm^3$ of the inner volume of the arc tube. The discharge lamps were operated with a nominal luminous current of roughly 3.5 A and a nominal luminous wattage of 200 W.

The measurement was taken using a simulated test device with the same cooling conditions as in a real projector device such that, for each discharge lamp, a cycle in which operation continued for 2 hours and 45 minutes and then was turned off for 15 minutes, was repeated without interruption for 500 hours and the state of the side tube parts was visually observed after 500 hours.

The evaluation had the following five-point rating scale:

(□); extremely good state of the side tube parts (o); good for the most part (Δ); good (▲); not a good state although continuation of lamp use is possible (×); continuation of lamp use is difficult.

The first three states were assessed as acceptable, and the last two states were assessed as unacceptable.

In the discharge lamps, the welding area had variances in the range from 0.1 $mm^2$ to 1.0 $mm^2$ and the welding distance likewise had variances in a range from 0 mm to 0.7 mm.

Figure 7:
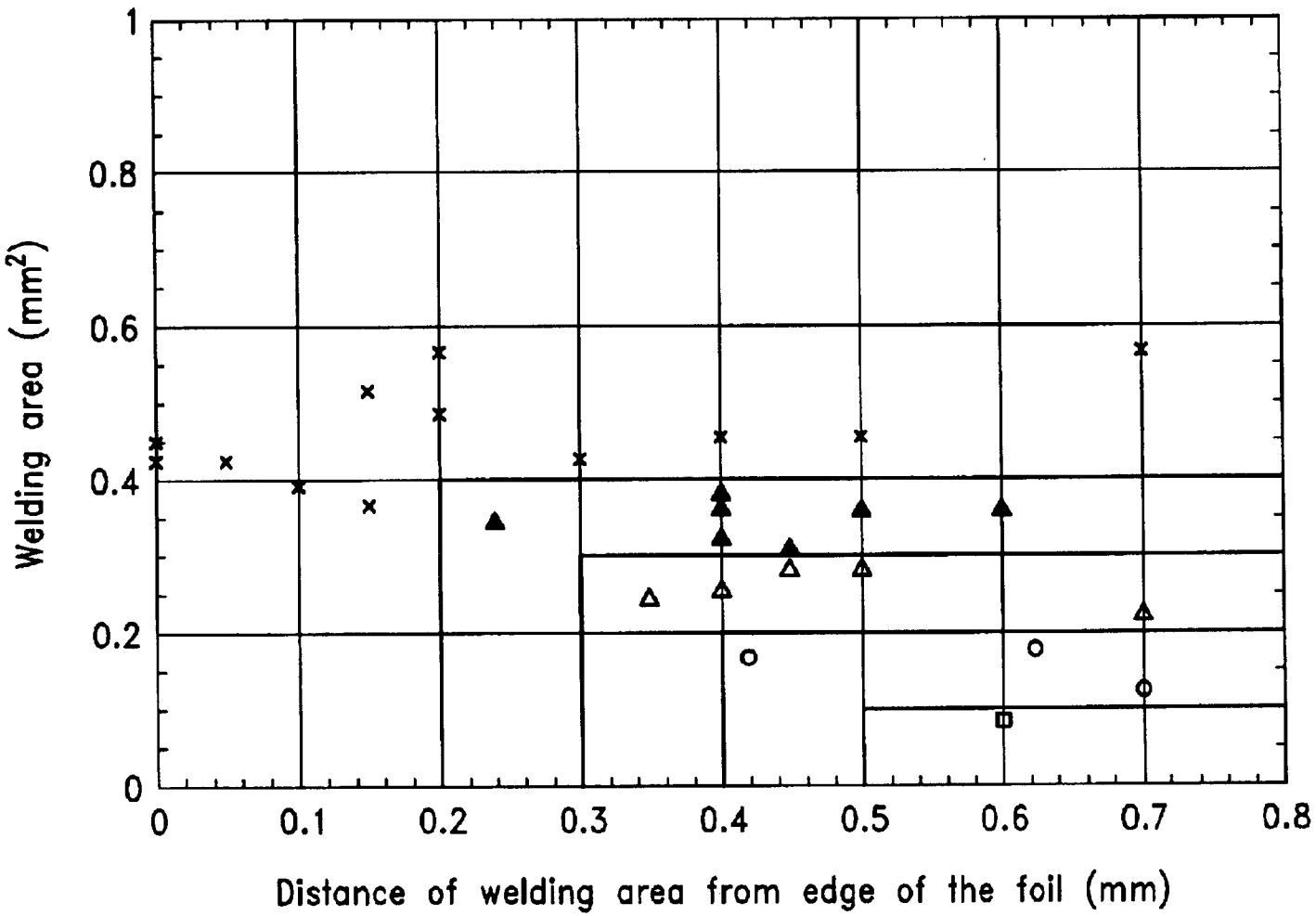
FIG. 7 shows a graph depicting the experimental results for the lamps in accordance with the invention.

FIG. 7 shows each of the discharge lamps with the y axis plotting the welding area and the x axis plotting the welding distance. It is apparent from the results shown in FIG. 7 that, for a welding area of less than 0.3 $mm^2$, an acceptable result is achieved, that for a welding area of less than 0.2 $mm^2$, a more advantageous state is obtained and that, for a welding area of smaller than 0.1 $mm^2$, an extremely advantageous state is obtained. Furthermore, it becomes apparent that, for a welding distance of greater than 0.3 mm, an acceptable result is achieved, that for a welding distance of at least 0.4 mm, a more advantageous state is achieved, and that at a welding distance of at least 0.5 mm an extremely advantageous state is obtained.

Furthermore, it is extremely useful to use the invention according to the above described aspects for the arrangement of Japanese patent application HEI 2000-168798.

In the above described embodiment, a discharge lamp of the direct current operating type was described. However, the arrangement of the invention can also be used for a discharge lamp of the alternating current type.

Additionally, by combining the different described aspects of the invention with one another, the disadvantage of formation of cracks and lamp damage can be even more effectively eliminated.

Specifically, in a short-arc, ultra-high pressure discharge lamp which comprises the following:

a light emitting part in which there are a pair of opposed electrodes and which is filled with at least 0.15 $mg/mm^3$ mercury; and side tube parts which extend from opposite sides of the light emitting part and in which the electrodes are partially hermetically sealed and in which the electrodes are each welded to a metal foil, and relative to which:

the electrodes are deformed in the areas welded to the metal foils in a direction perpendicular to the metal foil;

the degree of deformation is at most 10%;

the electrode diameter is 0.2 mm to 1.0 mm;

the width of the metal foil is 1.0 mm to 2.0 mm; and the welding area is at most 0.3 $mm^2$.

Furthermore, in a short-arc, ultra-high pressure discharge lamp which comprises the following:

a light emitting part in which there are a pair of opposed electrodes and which is filled with at least 0.15 $mg/mm^3$ mercury; and side tube parts which extend from opposite sides of the light emitting part and in which the electrodes are partially hermetically sealed and in which the electrodes are each welded to a metal foil, and relative to which:

the electrodes are deformed in the areas welded to the metal foils in a direction perpendicular to the metal foil;

the degree of deformation is at most 10%;

the electrode diameter is 0.2 mm to 1.0 mm;

the width of the metal foil is 1.0 mm to 2.0 mm; and the welding site is at least 0.3 mm from the end of the respective metal foil.

Furthermore, in a short-arc, ultra-high pressure discharge lamp which comprises the following:

a light emitting part in which there are a pair of opposed electrodes and which is filled with at least 0.15 $mg/mm^3$ mercury; and side tube parts which extend from opposite sides of the light emitting part and in which the electrodes are partially hermetically sealed and in which the electrodes are each welded to a metal foil, in the areas in which the electrodes are welded to the metal foils:

the electrode diameter is 0.2 mm to 1.0 mm;

the width of the metal foils is 1.0 mm to 2.0 mm;

the welding area is at most 0.3 $mm^2$; and the welding site is at least 0.3 mm from the end of the respective metal foil.

Furthermore, in a short-arc, ultra-high pressure discharge lamp which comprises the following:

a light emitting part in which there are a pair of opposed electrodes and which is filled with at least 0.15 $mg/mm^3$ mercury; and side tube parts which extend from opposite sides of the light emitting part and in which the electrodes are partially hermetically sealed and in which the electrodes are each welded to a metal foil, and in which:

the electrodes are deformed in the areas welded to the metal foils in a direction perpendicular to the metal foil;

the degree of deformation is at most 10%;

the electrode diameter is 0.2 mm to 1.0 mm;

the width of the metal foil is 1.0 mm to 2.0 mm;

the welding area is at most 0.3 $mm^2$; and the welding site is at least 0.3 mm from the end of the respective metal foil.

As was described above, the short-arc, ultra-high pressure discharge lamp in accordance with the invention has an ultra-high inner air pressure during operation of greater than 150 atm and also extremely strict thermal conditions. However, crack formation in the connecting area of the upholding parts of the electrodes with the metal foils and lamp damage can be advantageously eliminated.

What we claim is:

1. Short-arc, ultra-high pressure discharge lamp which comprises:

a light emitting part in which there are a pair of opposed electrodes and in which an inner volume of the light emitting part is filled with at least 0.15 $mg/mm^3$ of mercury; and side tube parts which extend from opposite sides of the light emitting part and in which the electrodes are partially hermetically sealed and in which the electrodes are each welded to a metal foil, wherein, in areas in which the electrodes have upholding parts that are welded to the metal foils, the upholding parts of the electrodes are deformed in a direction perpendicular to the metal foils and wherein a degree of deformation D2/D of the upholding parts of the electrodes is at most 10%, where D is the undeformed height of the upholding parts in said direction perpendicular to the metal foils and D2 is an extent to which the undeformed height has been reduced by the electrodes having been deformed.

2. Short-arc, ultra-high pressure discharge lamp which comprises:

a light emitting part in which there are a pair of opposed electrodes and in which an inner volume of the light emitting part is filled with at least 0.15 $mg/mm^3$ of mercury; and side tube parts which extend from opposite sides of the light emitting part and in which the electrodes are partially hermetically sealed and in which the electrodes are each welded to a metal foil, wherein, in areas in which the electrodes are welded to the metal foils, the electrodes have a diameter of 0.2 mm to 1.0 mm, the metal foils have a width of 1.0 mm to 2.0 mm and the areas in which the electrodes are welded to the metal foils are each at most 0.3 $mm^2$.

3. Short-arc, ultra-high pressure discharge lamp as claimed in claim 1, wherein, in the areas in which the electrodes are welded to the metal foils, the electrodes have a diameter of 0.2 mm to 1.0 mm, the metal foils have a width of 1.0 mm to 2.0 mm and the welding areas have an area of at most 0.3 $mm^2$.

4. Short-arc, ultra-high pressure discharge lamp as claimed in claim 1, wherein, in the areas in which the electrodes are welded to the metal foils, the electrodes have a diameter of 0.2 mm to 1.0 mm and the metal foils have a width of 1.0 mm to 2.0 mm, and wherein the welding areas are located at least 0.3 mm from an electrode-side edge of the respective metal foil.

5. Short-arc, ultra-high pressure discharge lamp as claimed in claim 3, wherein the welding areas are located at least 0.3 mm from an electrode-side edge of the respective metal foil.

6. Short-arc, ultra-high pressure discharge lamp as claimed in claim 2, wherein the welding areas are located at least 0.3 mm from an electrode-side edge of the respective metal foil.

* * * * *